US007068264B2

(12) United States Patent
Tomio et al.

(10) Patent No.: US 7,068,264 B2
(45) Date of Patent: Jun. 27, 2006

(54) FLAT DISPLAY PANEL HAVING INTERNAL POWER SUPPLY CIRCUIT FOR REDUCING POWER CONSUMPTION

(75) Inventors: Shigetoshi Tomio, Kawasaki (JP); Naoki Matsui, Kawasaki (JP); Shinpei Yao, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 397 days.

(21) Appl. No.: 09/974,806

(22) Filed: Oct. 12, 2001

(65) Prior Publication Data

US 2002/0044145 A1 Apr. 18, 2002

Related U.S. Application Data

(63) Continuation of application No. 09/013,538, filed on Jan. 26, 1998, now Pat. No. 6,522,314, which is a continuation of application No. 08/351,655, filed on Dec. 7, 1994, now abandoned, which is a continuation-in-part of application No. 08/188,760, filed on Jan. 31, 1994, now abandoned.

(30) Foreign Application Priority Data

Nov. 19, 1993 (JP) ..... 5-290868

(51) Int. Cl.
*G09G 5/00* (2006.01)

(52) U.S. Cl. ..... 345/211; 345/60

(58) Field of Classification Search ..... 345/211–212, 345/60–68; 315/169.4
See application file for complete search history.

(56) References Cited

U.S. PATENT DOCUMENTS 4,017,762 A * 4/1977 Criscimagna et al. .... 315/169.4
4,123,671 A 10/1978 Aihara et al.
4,200,868 A 4/1980 Lamoureux et al.
4,279,020 A 7/1981 Christian et al.
4,288,831 A 9/1981 Dolikian
4,347,509 A 8/1982 Hardway et al.
4,492,957 A 1/1985 Marentic
4,550,274 A 10/1985 Weber
4,591,914 A 5/1986 Hakamada et al.
4,614,880 A 9/1986 Go et al.
4,692,665 A 9/1987 Sakuma
4,848,876 A * 7/1989 Yamakawa ..... 345/87

(Continued)

FOREIGN PATENT DOCUMENTS

EP 0 488 891 6/1992

(Continued)

OTHER PUBLICATIONS

Nanto et al., "A 15-in. Diagonal Color Surface Discharge AC Plasma Display Panel," Japan Display '89, pp. 202-205.

(Continued)

*Primary Examiner*—Regina Liang
*Assistant Examiner*—Duc Dinh
(74) *Attorney, Agent, or Firm*—Staas & Halsey LLP

(57) ABSTRACT

A flat display employs at least one high voltage different from logic voltages. The display has a voltage detection unit and a drive control signal control unit. The voltage detection unit is used to detect the high voltage. The drive control signal control unit is used to control drive control signals of the flat display in accordance with the detected high voltage. This arrangement eliminates charging currents that are applied to a display panel but have nothing to do on the actual displaying of data, or reactive currents due to unnecessary switching operations, thereby reducing power consumption.

14 Claims, 15 Drawing Sheets

U.S. PATENT DOCUMENTS 4,855,892 A * 8/1989 Lower ..... 361/18
4,967,377 A 10/1990 Masuda
4,994,719 A 2/1991 Lendaro
5,003,228 A 3/1991 Hada et al.
5,008,846 A * 4/1991 Inoue ..... 713/321
5,036,261 A 7/1991 Testin
5,051,936 A 9/1991 Gleason, III et al.
5,075,597 A 12/1991 Salavin et al.
5,088,018 A 2/1992 Lee
5,206,630 A 4/1993 Kim
5,258,828 A 11/1993 Sano et al.
5,300,874 A * 4/1994 Shimamoto et al. ..... 307/66
5,323,171 A 6/1994 Yokouchi et al.
5,386,577 A 1/1995 Zenda
5,389,952 A 2/1995 Kikinis
5,436,634 A * 7/1995 Kanazawa ..... 345/60
5,454,112 A 9/1995 Kadono et al.
5,465,366 A * 11/1995 Heineman ..... 713/324
5,471,228 A 11/1995 Ilcisin et al.
5,511,201 A 4/1996 Kamimaki et al.
5,548,763 A 8/1996 Combs et al.
5,548,765 A 8/1996 Tsunoda et al.
5,563,624 A * 10/1996 Imamura ..... 345/100
5,583,527 A 12/1996 Fujisaki et al.
5,629,715 A 5/1997 Zenda
5,661,500 A 8/1997 Shinoda et al.
5,745,085 A 4/1998 Tomio et al.
5,786,813 A * 7/1998 Kurikko ..... 345/212
5,943,032 A 8/1999 Nagaoka et al.

FOREIGN PATENT DOCUMENTS

JP 3-58086 3/1991
JP 4-195188 7/1992
JP 4-278988 10/1992
JP 4-287089 10/1992

OTHER PUBLICATIONS

Shinoda et al., "Improvement of Luminance and Luminous Efficiency of Surface-Discharge Color ac PDP," SID 91 Digest, pp. 724-727.
Yoshikawa et al., "A Full Color AC Plasma Display with 256 Gray Scale," Japan Display '92, pp. 605-608.
Kanagu et al., "A 31-in. Diagonal Full-Color Surface-Discharge ac Plasma Display Panel," SID 92 DIGEST, pp. 724-727.
Shinoda et al., "Invited Address: Development of Technologies for Large-Area Color ac Plasma Display," SID 93 DIGEST, pp. 161-164.

* cited by examiner

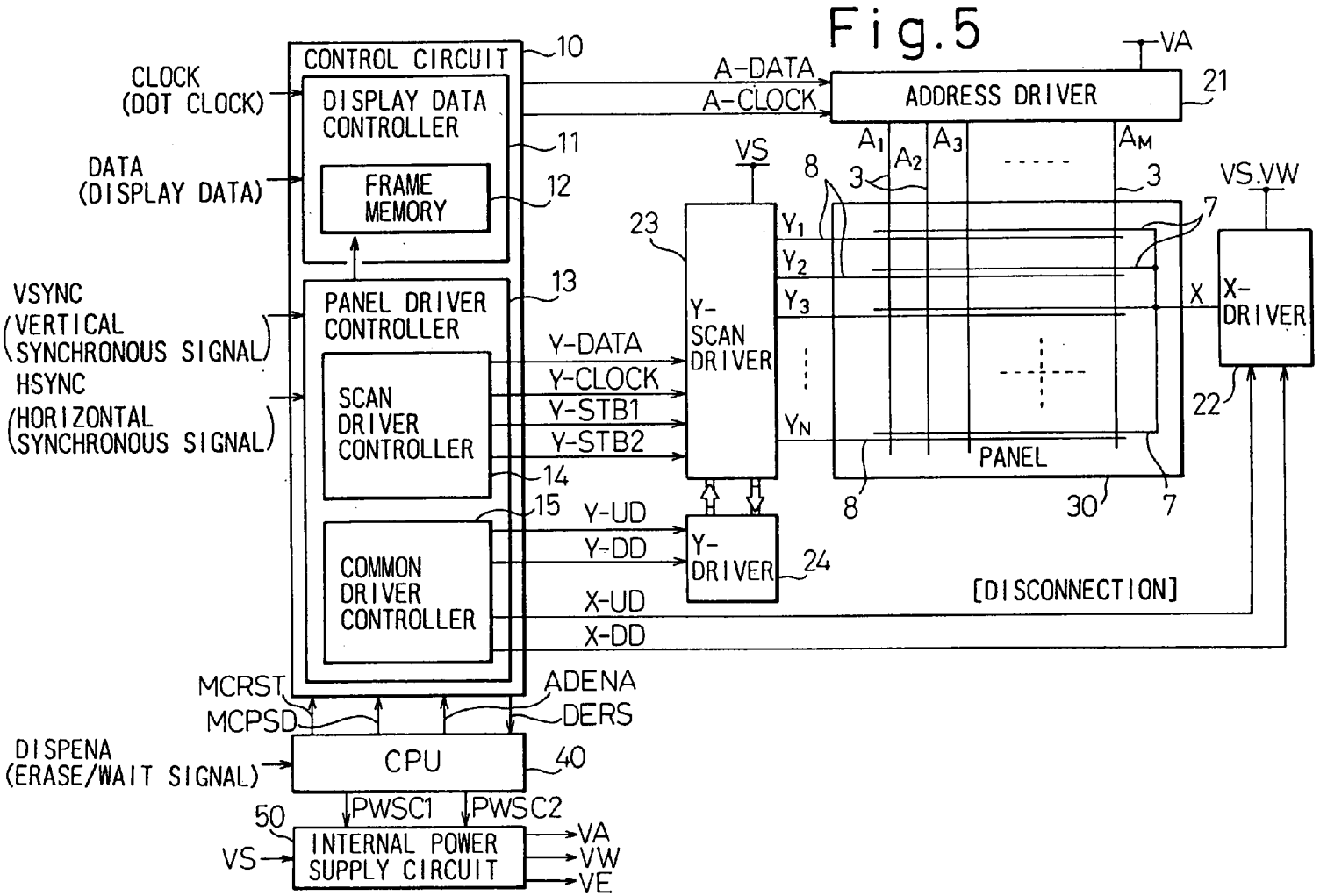
Fig.5
ADDRESS DRIVER
VA
21
A-DATA
A-CLOCK
A1
A2
A3
AM
3
8
7
X
X-DRIVER
VS,VW
22
PANEL
30
[DISCONNECTION]
Y1
Y2
Y3
YN
VS
Y-SCAN DRIVER
23
Y-DRIVER
24
Y-DATA
Y-CLOCK
Y-STB1
Y-STB2
Y-UD
Y-DD
X-UD
X-DD
ADENA
DERS
CONTROL CIRCUIT
10
DISPLAY DATA CONTROLLER
11
FRAME MEMORY
12
PANEL DRIVER CONTROLLER
13
SCAN DRIVER CONTROLLER
14
COMMON DRIVER CONTROLLER
15
CPU
40
PWSC1
PWSC2
INTERNAL POWER SUPPLY CIRCUIT
50
VA
VW
VE
VS
CLOCK (DOT CLOCK)
DATA (DISPLAY DATA)
VSYNC (VERTICAL SYNCHRONOUS SIGNAL)
HSYNC (HORIZONTAL SYNCHRONOUS SIGNAL)
MCRST
MCPSD
DISPENA (ERASE/WAIT SIGNAL)

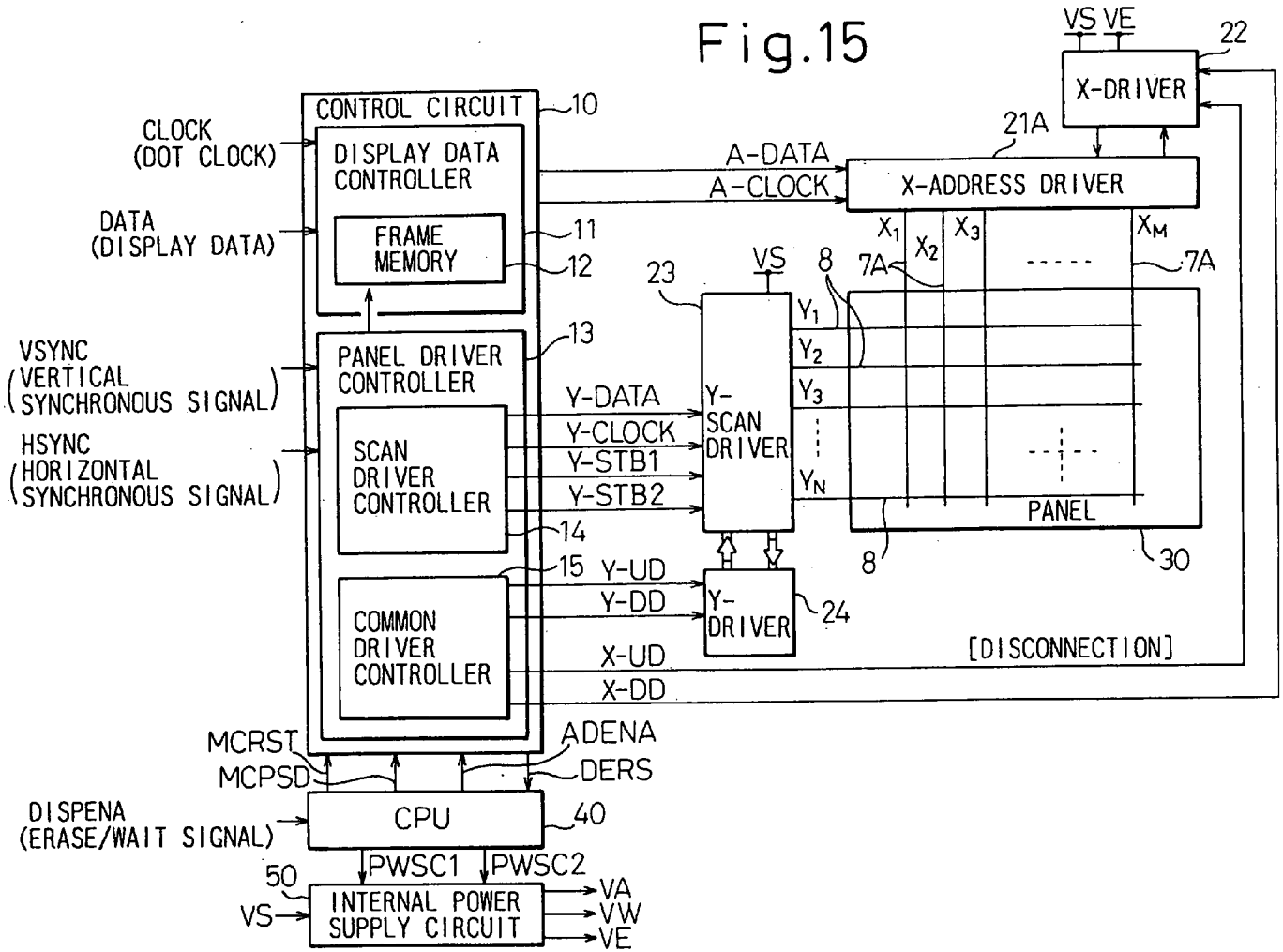
Fig.15
CONTROL CIRCUIT
DISPLAY DATA CONTROLLER
FRAME MEMORY
PANEL DRIVER CONTROLLER
SCAN DRIVER CONTROLLER
COMMON DRIVER CONTROLLER
CPU
INTERNAL POWER SUPPLY CIRCUIT
X-DRIVER
X-ADDRESS DRIVER
PANEL
Y-SCAN DRIVER
Y-DRIVER
[DISCONNECTION]
A-DATA
A-CLOCK
Y-DATA
Y-CLOCK
Y-STB1
Y-STB2
Y-UD
Y-DD
X-UD
X-DD
ADENA
DERS
PWSC1
PWSC2
VA
VW
VE
MCRST
MCPSD
VS
VE
CLOCK (DOT CLOCK)
DATA (DISPLAY DATA)
VSYNC (VERTICAL SYNCHRONOUS SIGNAL)
HSYNC (HORIZONTAL SYNCHRONOUS SIGNAL)
DISPENA (ERASE/WAIT SIGNAL)

FLAT DISPLAY PANEL HAVING INTERNAL POWER SUPPLY CIRCUIT FOR REDUCING POWER CONSUMPTION

CROSS REFERENCE TO RELATED APPLICATION

This application is a continuation of Application Ser. No. 09/013,538 filed Jan. 26, 1998, now U.S. Pat. No. 6,522,314 which is a continuation application of application Ser. No. 08/351,655 filed Dec. 7, 1994, now abandoned which, in turn, is a continuation-in-part application of Ser. No. 08/188,760 filed on Jan. 31, 1994 now abandoned.

BACKGROUND OF THE INVENTION

1. Field of the Invention

The present invention relates to flat displays, and particularly, to flat displays employing a plasma display panel, an electroluminescence panel, a liquid crystal panel, a fluorescent display tube, or light emitting diodes.

2. Description of the Related Art

The sizes and capacities of flat displays are increasing, due to the requirement for full-color displays, and the power consumption of the flat displays is increasing accordingly. The power consumption must be minimized.

For example, in the plasma display panel, to erase the whole screen of the flat display, non-display data may be entered to the display, or a signal DISPENA may be supplied to turn OFF the output of an address driver of the display. Once the screen is wholly erased, no address pulse is applied to form wall charges. Sustain pulses, however, are applied even thereafter, although they do nothing on the display. These sustain pulses waste electric power in the conventional flat displays.

SUMMARY OF THE INVENTION

An object of the present invention is to reduce the power consumption of a flat display by eliminating useless charging currents, as well as eliminating reactive currents caused by useless switching, from a display panel.

According to the present invention, there is provided a flat display employing at least one high voltage, different from logic voltages, wherein the flat display comprises a voltage detection unit for detecting the high voltage; and a drive control signal control unit for controlling drive control signals of the flat display in response to the detected high voltage.

The flat display may further comprise an internal power supply controlling unit for controlling an operation of an internal power supply circuit. The internal power supply controlling unit may control an operation of the internal power supply circuit by changing power supply control signals in response to the detected high voltage and the other drive voltages which are produced by the high voltage. The drive control signal control unit may control an operation of a display panel driving unit by changing the drive control signals in response to the detected high voltage and the other drive voltages which are produced by the high voltage.

The drive control signal control unit and the internal power supply controlling unit may stop circuit operation through a control circuit if the detected high voltage is below a specific value set in the flat display, and start the circuit operation through the control circuit if the detected high voltage reaches the specific value, and thereby the drive control signals may be controlled in response to changes in the detected high voltage. The drive control signal control unit and the internal power supply controlling unit may store at least first and second specific values to be compared with the detected high voltage, the first specific value being used at a rise of the high voltage and the second specific value being used at a fall of the high voltage.

Further, according to the present invention, there is provided a flat display employing at least one high voltage different from logic voltages, wherein the flat display comprises an external signal detection unit for detecting a specific signal input from the external of the flat display; and a drive control signal control unit for controlling drive control signals of the flat display in response to the detected specific signal.

The flat display may further comprise an internal power supply controlling unit for controlling an operation of an internal power supply circuit. The internal power supply controlling unit may control an operation of the internal power supply circuit by changing power supply control signals in response to the detected specific signal. The drive control signal control unit may control an operation of a display panel driving unit by changing the drive control signals in response to the detected specific signal. The drive control signal control unit and the internal power supply controlling unit may stop circuit operation through a control circuit if the specific signal is at a first level, and start the circuit operation through the control circuit if the detected specific signal is at a second level, and thereby the drive control signals may be controlled in response to a level of the specific signal.

According to the present invention, there is also provided a flat display employing at least one high voltage different from logic voltages, wherein the flat display comprises a display data checking unit for checking display data input to the flat display from the external; and a drive control signal control unit for controlling drive control signals of the flat display in accordance with the checked display data.

The flat display may further comprise an internal power supply controlling unit for controlling an operation of an internal power supply circuit. The internal power supply controlling unit may control an operation of the internal power supply circuit by changing power supply control signals in response to the checked result of the display data. The drive control signal control unit may control an operation of a display panel driving unit by changing the drive control signals in response to the checked result of the display data. The drive control signal control unit and the internal power supply controlling unit may stop circuit operation through a control circuit if the display data is not input to the flat display during a specific period, and start the circuit operation through the control circuit if the display data is input to the flat display, and thereby the drive control signals may be controlled in response to the checked result of the display data.

In addition, according to the present invention, there is provided a flat display for displaying data with a high voltage and drive voltages produced from the high voltage, wherein the flat display comprises a first high voltage decision unit for determining whether or not the high voltage is at a specific value or a specific range after a power supply is turned on and initialization is carried out; a first drive voltage decision unit for determining whether or not the drive voltages are at specific values or specific ranges; a second high voltage decision unit for determining whether or not the high voltage is kept at the specific value or the specific range after the start of protective operation of an internal power supply circuit that generates the drive voltages; a second drive voltage decision unit for determining whether or not the drive voltages are kept at the specific values or the specific ranges; and a drive control signal control unit for controlling drive control signals of the flat display in response to the decided results of the decision units.

The control of the internal power supply circuit may be carried out together with the control of the drive control signals in response to the decided results of the second drive voltage decision unit.

The flat display may be initialized when the second high voltage decision unit determines that the high voltage is not kept at the specific value or the specific range, and an internal power of the internal power supply circuit and the drive voltages may be cut OFF when the second drive voltage decision unit determines that the drive voltages are not kept at the specific values or the specific ranges.

The flat display may further comprise a time compensation unit for compensating for the time between the instant that the high voltage is applied until the drive voltages reach the specific values. The specific value compared with the high voltage in the first high voltage decision unit may differ from the specific value compared with the high voltage in the second high voltage decision unit.

The flat display may be a three-electrode surface discharge AC plasma display. The three-electrode surface discharge AC plasma display may comprise first and second electrodes arranged in parallel with each other; and third electrodes orthogonal to the first and second electrodes, the first electrode being commonly connected together, and the second electrodes being arranged for display lines, respectively, wherein the display has a surface discharge structure employing wall charges as memory.

The three-electrode surface discharge AC plasma display may further comprise a first substrate, and the first and second electrodes being arranged in parallel with each other on the first substrate and paired for respective display lines; a second substrate spaced apart from and facing the first substrate, and the third electrodes being arranged on the second substrate away from and orthogonal to the first and second electrodes; a wall charge accumulating dielectric layer covering the surfaces of the first and second electrodes; a phosphor formed over the second substrate; a discharge gas sealed in a cavity defined between the first and second substrates; and cells formed at intersections where the first and second electrodes cross the third electrodes.

BRIEF DESCRIPTION OF THE DRAWINGS

The present invention will be more clearly understood from the description of the preferred embodiments as set forth below with reference to the accompanying drawings, wherein:

FIG. 5 is a block diagram showing a 3-electrode surface discharge AC plasma display system according to an embodiment of the present invention;

FIG. 15 is a block diagram showing a 2-electrode surface discharge AC plasma display system according to another embodiment of the present invention.

DESCRIPTION OF THE PREFERRED EMBODIMENTS

For a better understanding of the preferred embodiments, the problems of the prior art will be explained with reference to FIGS. 1 to 4.

Flat displays usually employ a PDP (plasma display panel), EL (electroluminescence) elements, an LCD (liquid crystal display), a VFD (fluorescent display), or LEDs (light emitting diodes). The present invention is applicable to these various types of flat displays. In the following descriptions, however, the present invention is explained with reference to a 3-electrode surface discharge AC plasma display system (AC PDP).

Figure 1:
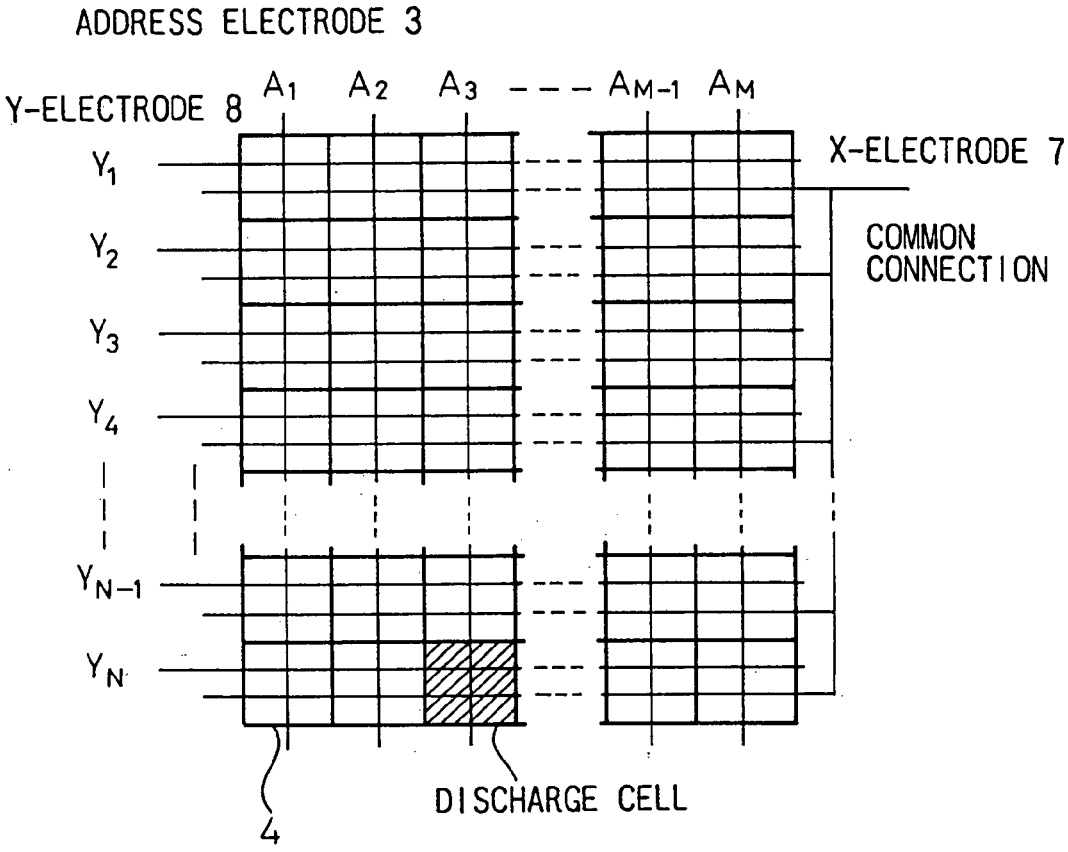
Fig.1 (PRIOR ART)
FIG. 1 is a model view showing a 3-electrode surface discharge AC plasma display panel according to a prior art.
Figure 2:
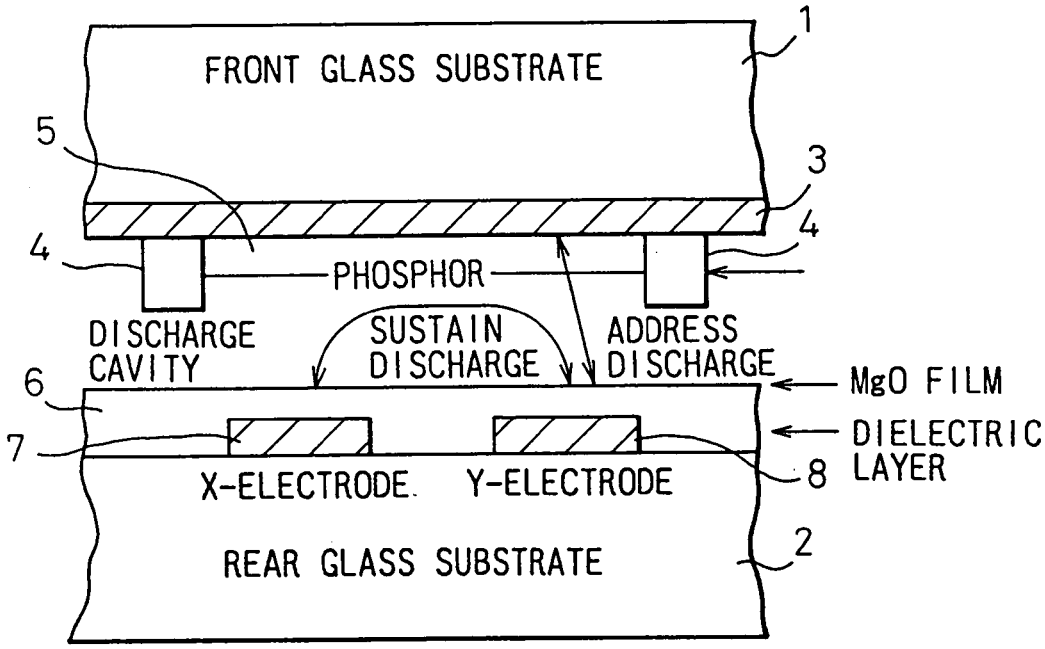
Fig.2 (PRIOR ART)
FIG. 2 is a section showing one discharge cell in the plasma display panel of FIG. 1.

FIG. 1 is a model view showing a 3-electrode surface discharge AC plasma display panel according to the prior art, and FIG. 2 is a section showing the structure of one discharge cell in the panel of FIG. 1. The panel is made of M×N dots.

The panel has a front glass substrate 1, a rear glass substrate 2, address electrodes 3, separators (walls) 4, phosphor 5 surrounded by the separators 5, a dielectric layer 6, X-electrodes 7, and Y-electrodes 8. Discharge is mainly carried out between a pair of the X-and Y-electrodes 7 and 8 arranged on the rear glass substrate 2. These electrodes 7 and 8 are called sustain discharge electrodes.

To select cells in a selected display line involving a corresponding one of the Y-electrodes 8, according to display data, discharge is carried out between the corresponding Y-electrode 8 and the address electrodes 3.

The insulation dielectric layer 6 is formed over the sustain discharge electrodes 7 and 8. A protective MgO film is formed over the dielectric layer 6. The front glass substrate 1 is positioned opposite to the rear glass substrate 2, and the address electrodes-3 and phosphor 5 are formed on the front glass substrate 1. In response to discharge, the phosphor 5 emits a corresponding one of red, green, and blue light. The phosphor 5 is formed over the address electrodes 3.

The separators or barriers 4 are formed on one or both of the glass substrates, to define discharge cavities for the cells, respectively. Discharge is discretely carried out in the cells. The discharge produces ultraviolet rays that cause the phosphor to emit light. The cells are arranged in a matrix of M×N dots to form the display panel of FIG. 1. In FIG. 1, reference marks $A_1$ to $A_M$ represent the address electrodes 3, and $Y_1$ to $Y_N$ the Y-electrodes 8. The X electrodes 7 are connected together.

Figure 3:
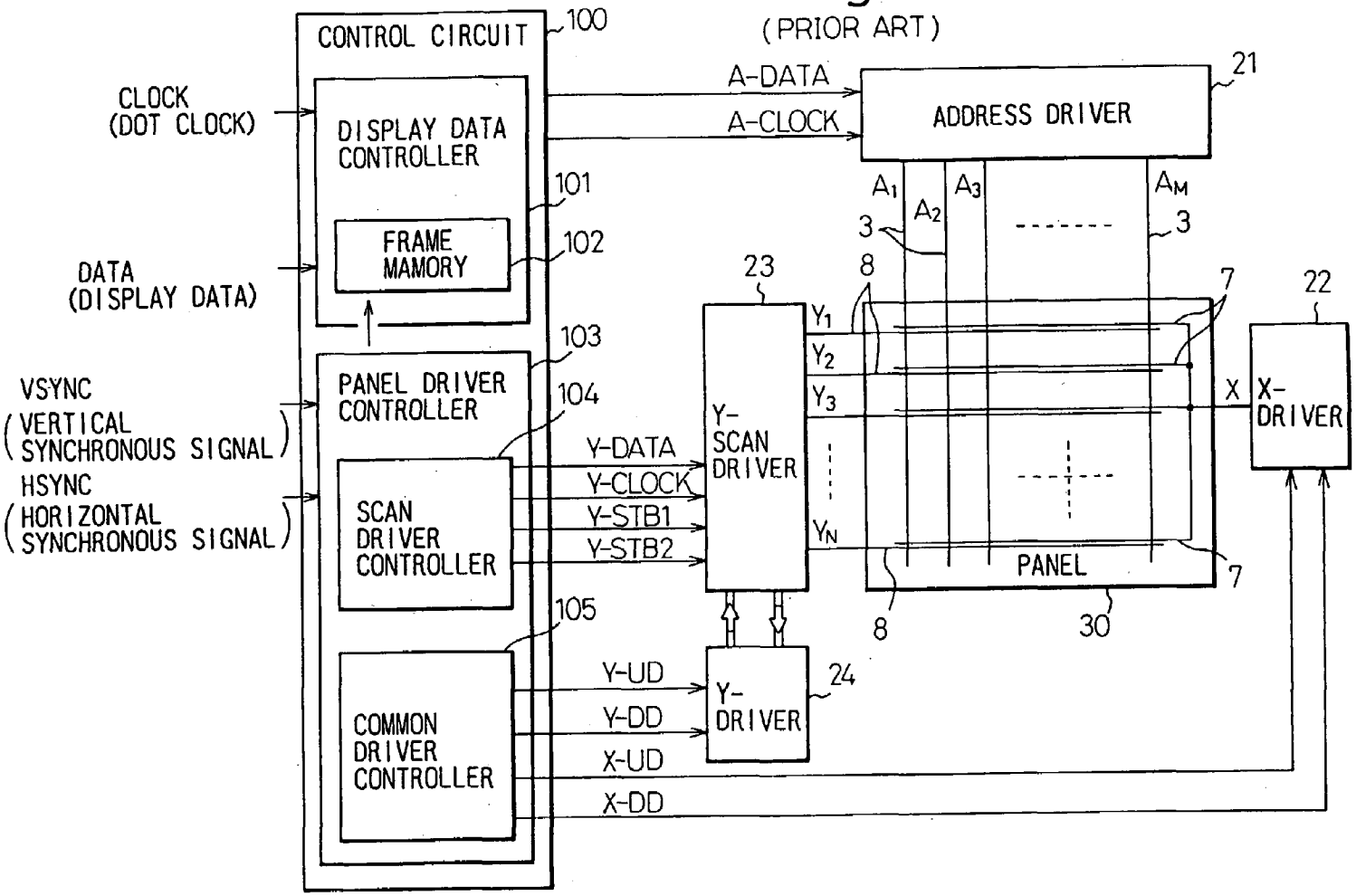
Fig.3 (PRIOR ART)
FIG. 3 is a block diagram showing a 3-electrode surface discharge AC plasma display system employing the panel of FIG. 1.

FIG. 3 is a block diagram showing a 3-electrode surface discharge AC plasma display system employing the panel of FIG. 1. This display involves peripheral circuits for driving the panel.

The display system has a control circuit 100, a display data controller 101, a frame memory 102, a panel driver controller 103, a scan driver controller 104, and a common driver controller 105. The display further has an address driver 21, an X-driver 22, a Y-scan driver 23, a Y-driver 24, and the plasma display panel (PDP) 30.

The display employs a dot clock (CLOCK) indicating display data, display data (DATA) of 3×8 bits, i.e., 8 bits for each color to display colors with 256 shades of gray, a vertical synchronous signal (VSYNC) indicating the start of a frame (a field), and a horizontal synchronous signal (HSYNC) indicating the start of a line.

The control circuit 100 has a display data controller 101 and a panel driver controller 103. The display data controller 101 stores display data in the frame memory 102 and transfers the data to the address driver 21 according to panel drive timing. A reference mark A-DATA indicates the display data, and A-CLOCK is a transfer clock.

The panel driver controller 103 has a scan driver controller 104 and a common driver controller 105, to determine the timing of applying a high voltage waveform to the panel 30. The reference mark Y-DATA is scan data for turning ON the Y-scan driver 23 bit by bit, Y-CLOCK is a transfer clock for turning ON the Y-scan driver 23 bit by bit, Y-STB1 is a Y-strobe 1 for determining the timing of turning ON the Y-scan driver 23, and Y-STB2 is a Y-strobe 2. Further, X-UD is a signal (VS/NW) to turn ON/OFF the X-common driver 22, X-DD is a signal (GND) to turn ON/OFF the X-common driver 22, Y-UD is a control signal (VS/VW) to turn ON/OFF the Y-common driver 24, and Y-DD is a control signal (GND) to turn ON/OFF the Y-common driver 24.

The address electrodes 3 ($A_1$ to $A_M$) are discretely connected to the address driver 21, which applies address pulses to the electrodes 3 to cause address discharge. The Y-electrodes 8 ($Y_1$ to $Y_N$) are discretely connected to the Y-scan driver 23. The Yscan driver 23 is connected to the Y-common driver (Y-driver) 24 The Y-scan driver 23 produces pulses to cause corresponding address discharge 8 The Y-driver 24 produces sustain pulses, etc., which are applied to the Y-electrodes 8 through the Y-scan driver 23

All of the X-electrodes 7 on the panel 30 are connected together. The X-common driver (X-driver) 22 produces write pulses, sustain pulses, etc.

These drivers are controlled by the control circuit 100, which is controlled by the external synchronous signals and display data signals.

Figure 4:
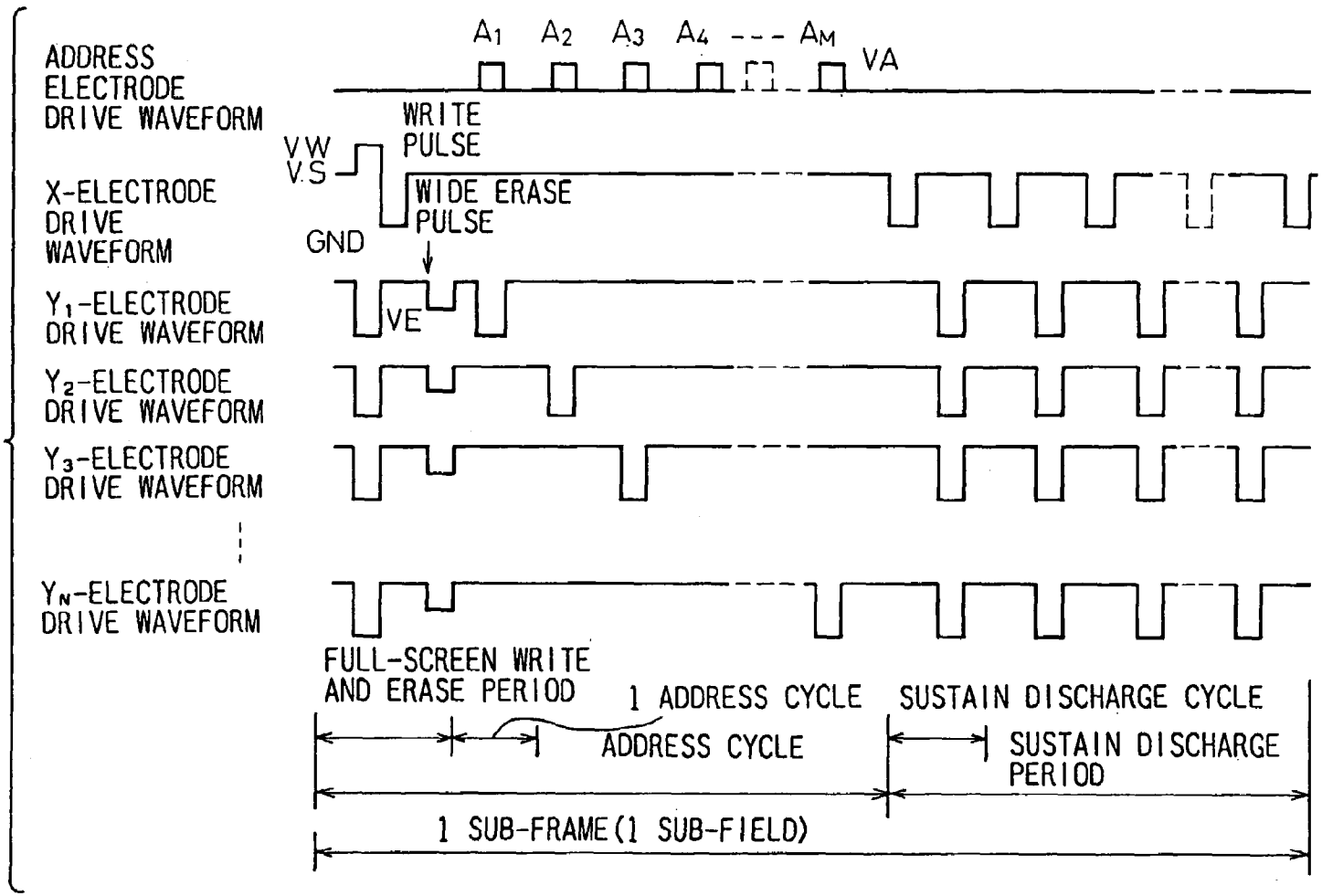
Fig.4 (PRIOR ART)
FIG. 4 is a diagram showing waveforms for driving the plasma display of FIG. 3.

FIG. 4 shows examples of waveforms for driving the plasma display of FIG. 3. These waveforms are produced within a sub-frame or a sub-field according to a write addressing method with separate address and sustain discharge. This method is effective to display full colors with multiple shades of gray and stably drive and address the display with low voltages.

In FIG. 4, the sub-frame is divided into an address period and a sustain discharge period. During the address period, full-screen write, full-screen erase, and line-by-line write (address) processes are carried out. During the sustain discharge period, sustain pulses are simultaneously applied to all display lines, to cause sustain discharge in cells where wall charges have been accumulated during the write (address) process.

When an interlace method is employed to divide a frame into two sub-frames, the sub-frame of FIG. 4 will correspond to a sub-field contained in each of the divided sub-frames.

The driving method of FIG. 4 is characterized in that the full-screen write and erase processes are carried out at the start of the address period, to equalize the conditions of all cells, and that the full-screen erase process leaves wall charges, which advantageously act on the next line-by-line write discharge (address discharge).

At first, the Y-electrodes are set to GND level, and a write pulse of voltage VW is applied to the X-electrodes, to carry out the full-screen write process. At this time, ions, i.e., positive charges are accumulated on the phosphor on the address electrodes. Then, an erase pulse of voltage VE is applied to carry out the full-screen erase process. This process erases wall charges on the insulation MgO film on the X- and Y-electrodes. It is preferred, however, to leave negative charges, i.e., electrons, on the MgO film on the Y-electrodes, so that the negative charges advantageously work on the next address discharge. At this time, the voltage of the remaining wall charges must not cause sustain discharge when sustain discharge pulses are applied to the X- and Y-electrodes.

In this way, the full-screen write and erase processes are carried out to equalize the conditions of the cells and to lower an addressing voltage. Thereafter, the write discharge (address discharge) process is carried out on the lines one by one. The Y-electrode of a line to be written is set to GND level, and an address pulse of voltage VA is applied to the address electrodes corresponding to cells to be written in the line. At this time, ions are on the phosphor on the address electrodes, and electrons are on the MgO film on the Y-electrodes. Accordingly, the address discharge occurs at a very low voltage. After all display lines are sequentially subjected to the address discharge, a sustain pulse of voltage VS is alternately applied to the X- and and Y-electrodes to carry out sustain discharge.

To entirely erase the screen of the plasma display panel according to the prior art of FIGS. 1 to 4, non-display data may be entered to the display, or a signal DISPENA may be applied to turn OFF the outputs of the address driver. After the screen is entirely erased accordingly, no address pulse is applied to accumulate wall charges. Sustain pulses, however, are applied during the sustain discharge period that follows the address period as shown in FIG. 4. Namely, the conventional flat display generates sustain pulses that do nothing on the display and waste electric power.

Next, preferred embodiment of a flat display according to the present invention will be explained with reference to the accompanying drawings.

FIG. 5 is a 3-electrode surface discharge AC plasma display according to the embodiment of the present invention. The display includes peripheral circuits for driving a typical 3-electrode AC PDP.

As shown in FIG. 5, the display has a control circuit 10, a display data controller 11, a frame memory 12 a panel driver controller 13 a scan driver controller 14 and a common driver controller 15. The display has an address driver 21, an X-driver 22, a Y-scan driver 23, a Y-driver 24, and the plasma display panel (PDP) 30. The display has a CPU 40 which generates a control signal ADENA for the display data controller 11, and an internal power supply circuit 50 which generates drive voltages VA, VW, and VE.

Note that, references MCRST and MCPSD denote control signals (drive control signals) for the display panel driver controller 13, DERS denotes a signal indicating that display data DATA is not supplied (or indicating a display erasing state), and PWSC1 and PWSC2 denote control signals (power supply control signals).

What is different from the plasma display of FIG. 3 is that the plasma display of FIG. 5 is provided with the CPU 40 that supplies the control circuit 10 with the drive control signals MCRST, MCPSD, and ADENA, and also provides an internal power supply circuit 50 with the power supply control signals PWSC1 and PWSC2. Further, the CPU 40 receives the signal DERS indicating the display erasing state from the control circuit 10.

The control circuit 10 and internal power supply circuit 50 are modified to receive the control signals MCRST, MCPSD, ADENA, PWSC1, and PWSC2 from the CPU 40 and the CPU 40 is modified to receive the signals DERS from the control circuit 10. The details of the modifications will be explained later. Other arrangements of the plasma display according to the embodiment of FIG. 5 are basically the same as those of FIG. 3.

In FIG. 5, the display employs a dot clock CLOCK for indicating display data, display data DATA involving 3×8 bits, i.e., 8 bits for each color to display colors with 256 shades of gray, a vertical synchronous signal VSYNC indicating the start of a frame (a field), and a horizontal synchronous signal HSYNC indicating the start of a line. A reference mark A-DATA denotes the display data, and A-CLOCK is a transfer clock.

The control circuit 10 has the display data controller 11 and panel driver controller 13. The display data controller 11 stores display data DATA in the frame memory 12 and transfers the data to the address driver 21 according to panel drive timing. Note that, in the display data controller 11, the display data DATA is checked, and when the display data DATA is not supplied during a specific period (display erasing state), the signal DERS is output to the CPU 40 from the control circuit 10 (display data controller 11). Namely, the input display data DATA is checked in the display data controller 11, and the checked result is supplied to the CPU by the signal DERS.

The panel driver controller 13 has a scan driver controller 14 and a common driver controller 15 to determine the timing of applying a high voltage waveform to the panel 30. A reference mark Y-DATA is scan data for turning ON the Y-scan driver 23 bit by bit, Y-CLOCK is a transfer clock for turning ON the Y-scan driver 23 bit by bit, Y-STB1 is a Y-strobe 1 for determining the timing of turning ON the Y-scan driver 23 and Y-STB2 is a Y-strobe 2. Further, X-UD is a signal (VSNW) to turn ON/OFF the X-common driver 22 X-DD is a signal (GND) to turn ON/OFF the X-common driver 22 Y-UD is a control signal (VSNW) to turn ON/OFF the Y-common driver 24 and Y-DD is a control signal (GND) to turn ON/OFF the Y-common driver 24.

The address electrodes 3 connected to the address driver 21, which applies address pulses to the electrodes 3 to cause address discharge. The Y-electrodes 8 are connected to the Y-scan driver 23. The Y-scan driver 23 is connected to the Y-common driver (Y-driver) 24. The Y-scan driver 23 produces pulses to cause address discharge. The Y-driver 24 produces sustain pulses, etc., which are applied to the Y-electrodes 8 through the Y-scan driver 23. All of the x-electrodes 7 on the panel 30 are connected together. The X-common driver (X-driver) 22 produces write pulses, sustain pulses, etc. These drivers are controlled by the control circuit 10, which is controlled according to the external synchronous signals, display data signals, and the control signals MCRST, MCPSD, and ADENA provided by the CPU 40.

In the embodiment of the present invention, a high voltage VS for displaying, a signal DISPENA, and a signal DERS are internally detected. Note that the signal DISPENA indicates erase or waiting (stand by) state and is input from the external of the display, and the signal DERS indicates no display data (or indicates that display data DATA is not supplied during a specific period). When the detected high voltage (VS) is below a specific value set in the flat display (for example, at a rise of the high voltage of a power ON state or a fall of the high voltage of a power OFF state), the display is stopped and a display operation of an abnormal (inferior) image can be avoided.

Further, when the signal DISPENA, input from the external, is at a specific level (low level L) or when the signal DERS is at a specific level (low level L) indicating that the display data DATA is not supplied during a specific period, the display is brought to a non-display state. Namely, in the above embodiment, as shown in FIG. 5, the CPU 40 receives the signal (specific signal) DISPENA from the external of the display, and when the signal DISPENA is at a specific level (low level (L)), the drive signals for the panel are stopped by the control signals (drive control signals) MCRST, MCPSD, and ADENA. Note that, when the specific signal DISPENA is at the specific level, the outputs of the address driver are turned OFF, and, further, the sustain pulses are also cut OFF.

Note that, in the above embodiment, the display can be stopped when the user (operator) intentionally cuts OFF, or decreases, the high voltage (VS) without employing an exclusive signal. When the operator intentionally cuts OFF the high voltage (VS) or decreases the high voltage (VS) below a specific value, which is previously set in the display, the drive signals (waveforms) for the panel are stopped by the control signals MCRST, MCPSD, and ADENA without using an exclusive signal and without providing an exclusive signal line. Namely, the flat display according to the embodiment internally detects the high voltage VS, to minimize a reactive current in a non-display state, i.e., an OFF state. If the detected high voltage VS is lower than a predetermined value (specific value), the control signals MCRST, MCPSD, and ADENA are provided to stop drive waveforms to the panel, to achieve a display OFF state. Note that the high voltage Vs is applied from outside the flat display, and is controlled by the user (operator).

Therefore, in the above embodiment, when the operator intentionally controls the high voltage (VS) or the signal DISPENA, the display can be brought to the non-display state and the consumption power of the display can be reduced.

As described above, according to the present embodiment, (1) when the display data DATA is not supplied during a specific period, (2) when the high voltage (VS) is below a specific value set in the flat display, or (3) when the specific signal DISPENA input from the external is at a specific level, charging currents that are irrelevant to an actual display operation and reactive currents due to useless switching operations are eliminated, so that power consumption can be reduced.

Figure 6A:
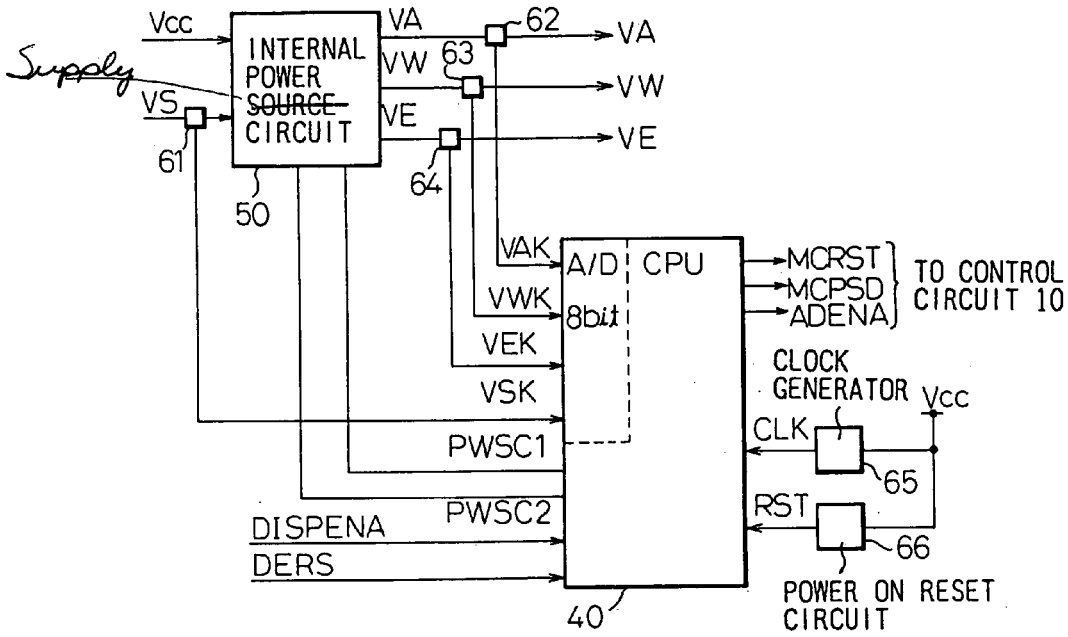
FIG. 6A is a block diagram showing essential part of the display system of FIG. 5.
Figure 6B:
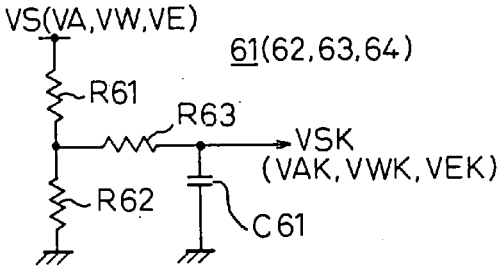
FIG. 6B is a circuit diagram showing a voltage detector of FIG. 6A.

FIG. 6A is a block diagram showing an essential part of the flat display of FIG. 5, and FIG. 6B is a circuit diagram showing a voltage detector of FIG. 6A. The part shown in FIG. 6A involves the CPU 40 internal power supply circuit 50 high-voltage detectors 61 to 64, a clock generator 65, and a power-on-reset circuit 66.

The internal power supply circuit 50 receives a power supply voltage Vcc and the high voltage VS and provides, according to PWM control, a voltage VA for an address discharge pulse, a voltage VW for a write discharge pulse, and a voltage VE for an erase pulse. The high voltage VS is detected by the high-voltage detector 61, the address discharge pulse voltage VA by the high-voltage detector 62, the write discharge pulse voltage VW by the high-voltage detector 63, and the erase pulse voltage VE by the high-voltage detector 64. Note that the high voltage Vs is applied from outside the flat display, and is controlled by the user (operator). Namely, when the user selects a non-display state, the high voltage Vs is lowered.

In FIG. 6B, the high-voltage detector 61 (62, 63, 64) is made of resistors R61 to R63 and a capacitor C61, to provide a detection signal VSK (VAK, VWK, VEK).

The detection signals VSK, VAK, VWK, and VEK are supplied to an 8-bit analog-to-digital (A/D) converter incorporated in the CPU 40. The converted data is stored by an internal register in the CPU 40 so that the CPU 40 identifies each voltage value as 8-bit data representing 256 points. The CPU 40 also receives a clock signal CLK from the clock generator 65 and a power ON reset signal RST from the power-on-reset circuit 66. The CPU 40 provides the internal power supply circuit 50 with the power supply control signals PWSC1 and PWSC2 and the control circuit 10 with the drive control signals MCRST, MCPSD, and ADENA.

Figure 7:
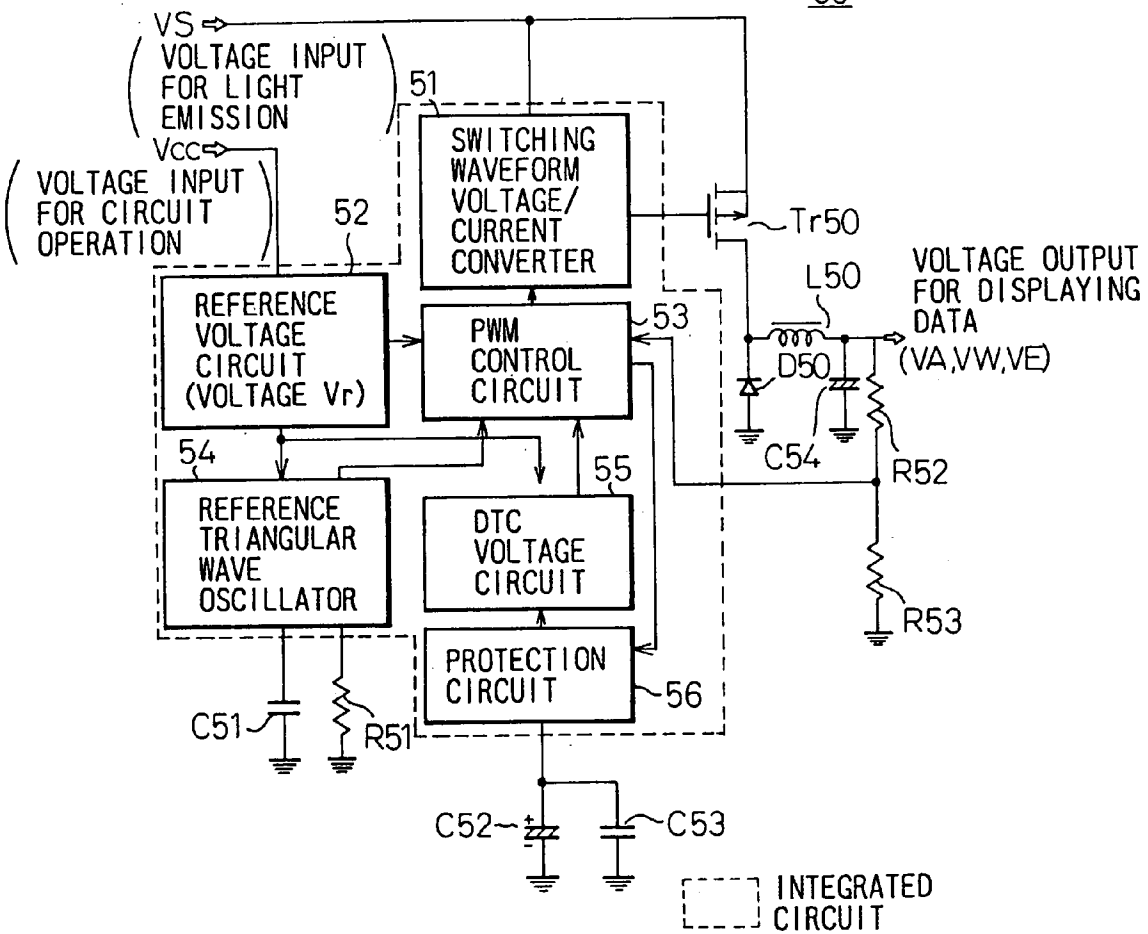
FIGS. 7 and 8 are block diagrams showing internal power supply circuits of FIG. 6A.
Figure 8:
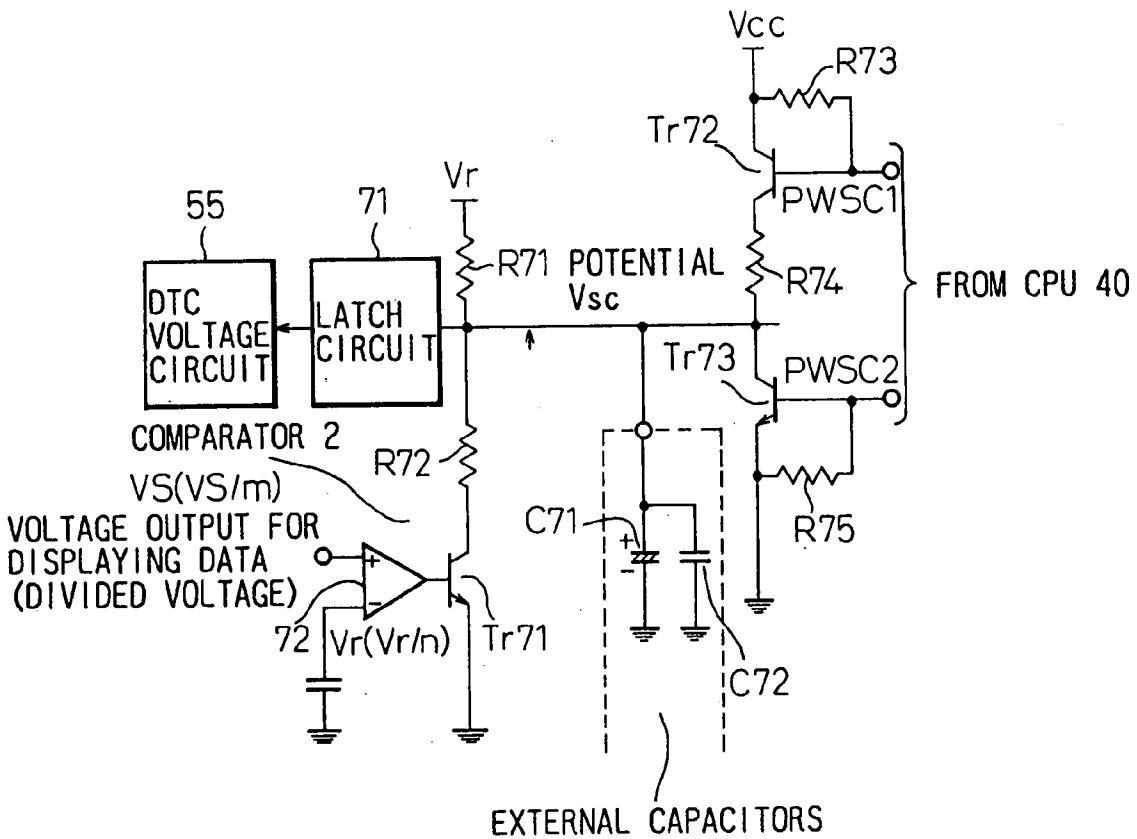
Figure 9:
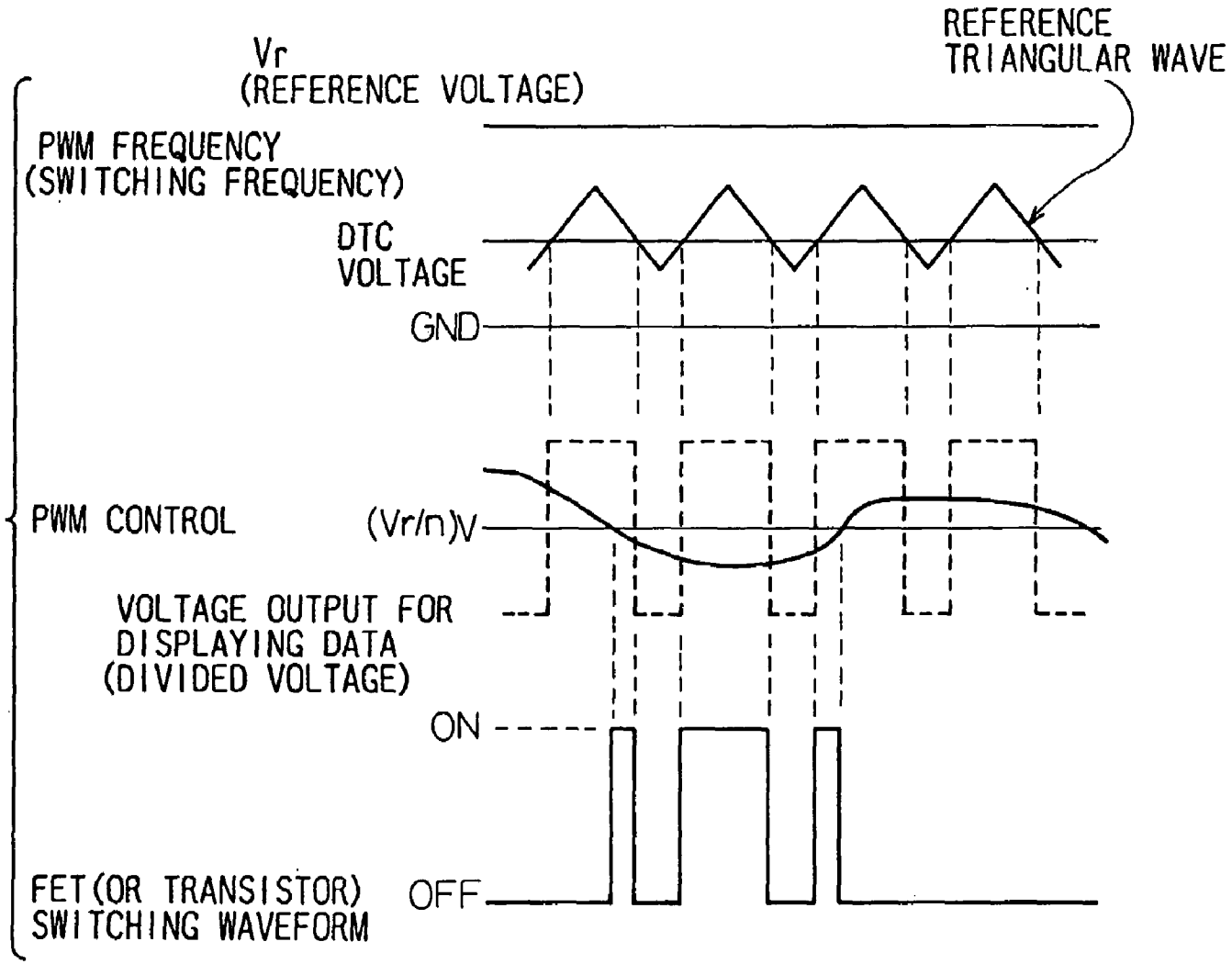
FIG. 9 is a diagram showing control waveforms at various parts of the internal power supply circuit of FIGS. 7 and 8.

FIGS. 7 and 8 are block diagrams showing the internal power supply circuit 50 of FIG. 6A, and FIG. 9 shows control waveforms at various parts of the internal power supply circuit 50. FIG. 7 shows the general arrangement of the internal power supply circuit 50 and FIG. 8 shows a circuit for processing the control signals PWSC1 and PWSC2 provided by the CPU 40 as well as a DTC voltage circuit 55 of FIG. 7. The details of the internal power supply circuit 50 of FIGS. 7 to 9 are disclosed in Japanese Patent Application No. 5-135952 filed by this applicant.

The internal power supply circuit 50 of FIG. 7 has a switching waveform voltage/current converter 51, a reference voltage circuit 52 for providing a reference voltage Vr, a PWM controller 53, a reference triangular wave oscillator 54, the DTC voltage circuit 55, and a protection circuit 56. These circuits are integrated in an IC chip. The internal power supply circuit 50 further has a FET Tr50, resistors R51 to R53, capacitors C51 to C54, a diode D50 and a choke coil L50. The capacitors C52 and C54 are electrolytic capacitors.

In FIG. 8, the internal power supply circuit 50 further has a latch circuit 71, a comparator 72, transistors Tr71 to Tr73, resistors R71 to R75, and capacitors C71 and C72. The capacitors C71 and C72 are externally arranged, and the capacitor C71 is an electrolytic capacitor.

An input of the comparator 72 receives the voltage VS(VS/m) derived from the high voltages), and the other input of the comparator 72 receives a voltage Vr(Vr/n) derived from the reference voltage Vr.

The control signals PWSC1 and PWSC2 are used to connect voltages obtained by dividing the high voltage VS through the resistors to the panel 30 as well as connecting output signals of the circuits for monitoring the voltage and current of the high voltage VS to the CPU 40.

In FIG. 8, potential Vsc is controllable in response to not only the switching status of the transistor Tr71 but also the switching statuses of the transistors Tr72 and Tr73 that are controlled by the control signals PWSC1 and PWSC2. This enables the high voltage VS to control the protection circuit 56.

The internal power supply circuit 50 of FIGS. 7 to 9 has the reference power supply for the protection circuit in the circuit 50. If one of the divided output voltages is higher than a corresponding reference voltage, internal switching operations are stopped to provide no output.

The protective operation and outputs of the internal power supply circuit 50 are controlled according to the control signals PWSC1 and PWSC2 provided by the CPU 40. The logic of the control signals PWSC1 and PWSC2 are as shown in Table 1.

TABLE 1

| PWSC1 | PWSCI | Circuit operation |
|---|---|---|
| H | H | Disable internal protection circuit |
| H | L | Start internal protection circuit |
| L | L | Stop outputs of internal power supply |

The signals PWSC1 and PWSC2 at a high level (H) disable the internal protection circuit. In this case, no protective operation is carried out. When the signal PWSC1 is H and the signal PWSC2 is low level (L), the internal protection circuit is started to enable the protective operation. When the signals PWSC1 and PWSC2 are each L, the outputs of the internal power supply circuit 50 are stopped.

Figure 10:
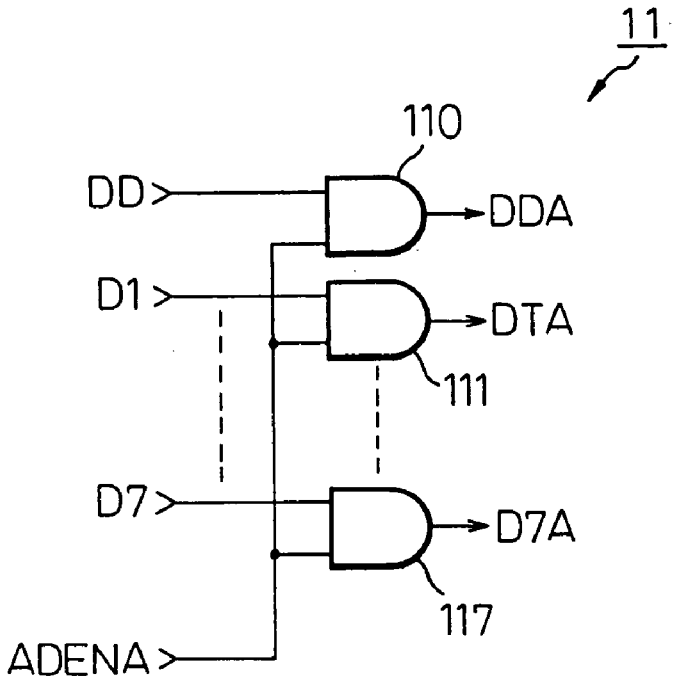
FIG. 10 is a circuit diagram showing an essential part of a display data controller of the display of FIG. 5.
Figure 11:
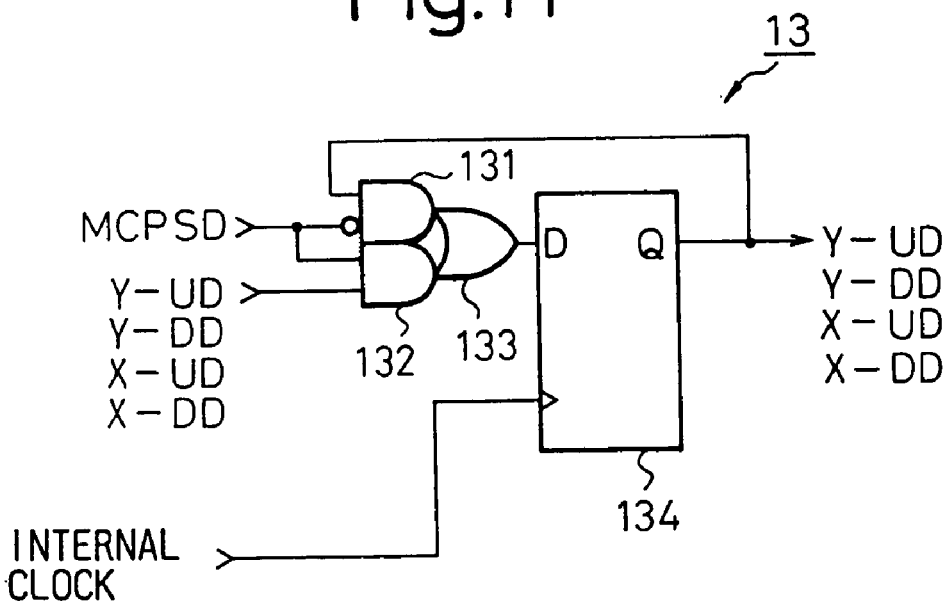
FIG. 11 is a circuit diagram showing an essential part of a panel driver controller of the flat display of FIG. 5.

FIG. 10 is a circuit diagram showing an essential part of the display data controller 11 of FIG. 5, and FIG. 11 is a circuit diagram showing an essential part of the panel driver controller 13 of FIG. 5. In FIG. 5, the CPU 40 provides the control circuit 10 with the control signals MCRST, MCPSD, and ADENA. The control signal ADENA is supplied to the display data controller 11, and the control signals MCRST and MCPSD are supplied to the panel driver controller 13.

In FIG. 10, the display data controller 11 has AND gates 110 to 117 and one input of each gate receives display data D0 to D7, respectively. The other input of each AND gate 110 to 117 receives the control signal ADENA. When the control signal ADENA is H, address data A-DATA (D0A to D7A) is supplied to the address driver 21. When the signal ADENA is L, no address data A-DATA (D0A to D7A) is supplied to the address driver 21. In this way, the address data A-DATA from the display data controller 11 of the control circuit 10 to the address driver 21 is controlled in response to the control signal ADENA.

In FIG. 11, the panel driver controller 13 (common driver controller 15) has AND gates 131 and 132, an OR gate 133, and a flip-flop 134. An inverting input of the AND gate 131 and an input of the AND gate 132 receive the control signal MCPSD. Outputs of the AND gates 131 and 132 are passed through the OR gate 133 and supplied to a data input of the flip-flop 134. The AND gate 132 receives the signals Y-UD, Y-DD, X-UD, and X-DD as well as the control signal MCPSD. Namely, the signals Y-UD, Y-DD, X-UD, and X-DD supplied from the common driver controller 15 of the control circuit 10 to the X- and Y-drivers 22 and 24 are controlled in response to the control signal MCPSD.

The control signal MCRST is applied to direct clear terminals of all of the latch circuits and flip-flops, and these latch circuits and flip-flops are initialized by the control signal MCRST of a specific level (low level (L)).

The levels of the control signals MCRST, MCPSD, and ADENA are as shown in Table 2.

TABLE 2

| | Initial Setting | Normal Operation | Abnormal Operation | Non-Data DERS = "L" | Present Date DERS = "H" | DISPENA = "L" |
|---|---|---|---|---|---|---|
| MCRST | L | H | L | L | H | L |
| MCPSD | H | L | H | H | L | H |
| ADENA | L | H | L | L | H | L |

As shown in the above table 2, initially, the signals MCRST and ADENA are each L (low level), and the signal MCPSD is H (high level). During normal operation, the signals MCRST and ADENA are H, and the signal MCPSD is L. During an abnormal process (abnormal operation), the signals MCRST and ADENA are each L, and the signal MCPSD is H.

Further, in the case that the signal DERS is L, that is, when the display data DATA is not supplied during a specific period, the signals MCRST and ADENA are L, and the signal MCPSD is H. On the other hand, in the case that the signal DERS is H, that is, when the display data DATA is supplied from the external, the signals MCRST and ADENA are H, and the signal MCPSD is L.

Further, in the case that the signal DISPENA is L, that is, when the apparatus having (controlling) the display panel changes the signal DISPENA to a low level (L) or the user (operator) intentionally changes the signal DISPENA to L, so as to bring the display to a non-display state, the signals MCRST and ADENA are L, and the signal MCPSD is H.

Figure 12:
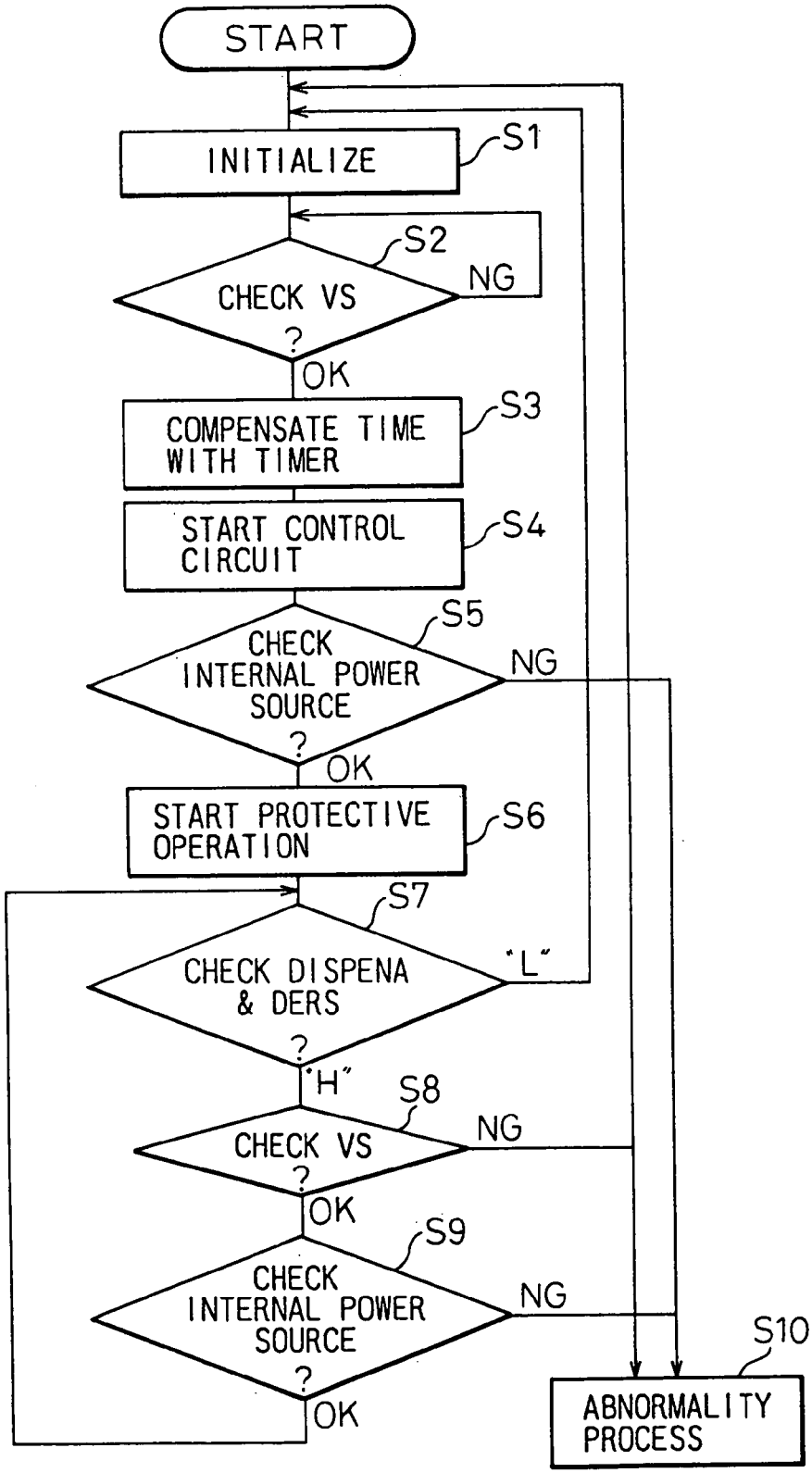
FIG. 12 is a flowchart showing processes carried out in the display according to the present invention.
Figure 13:
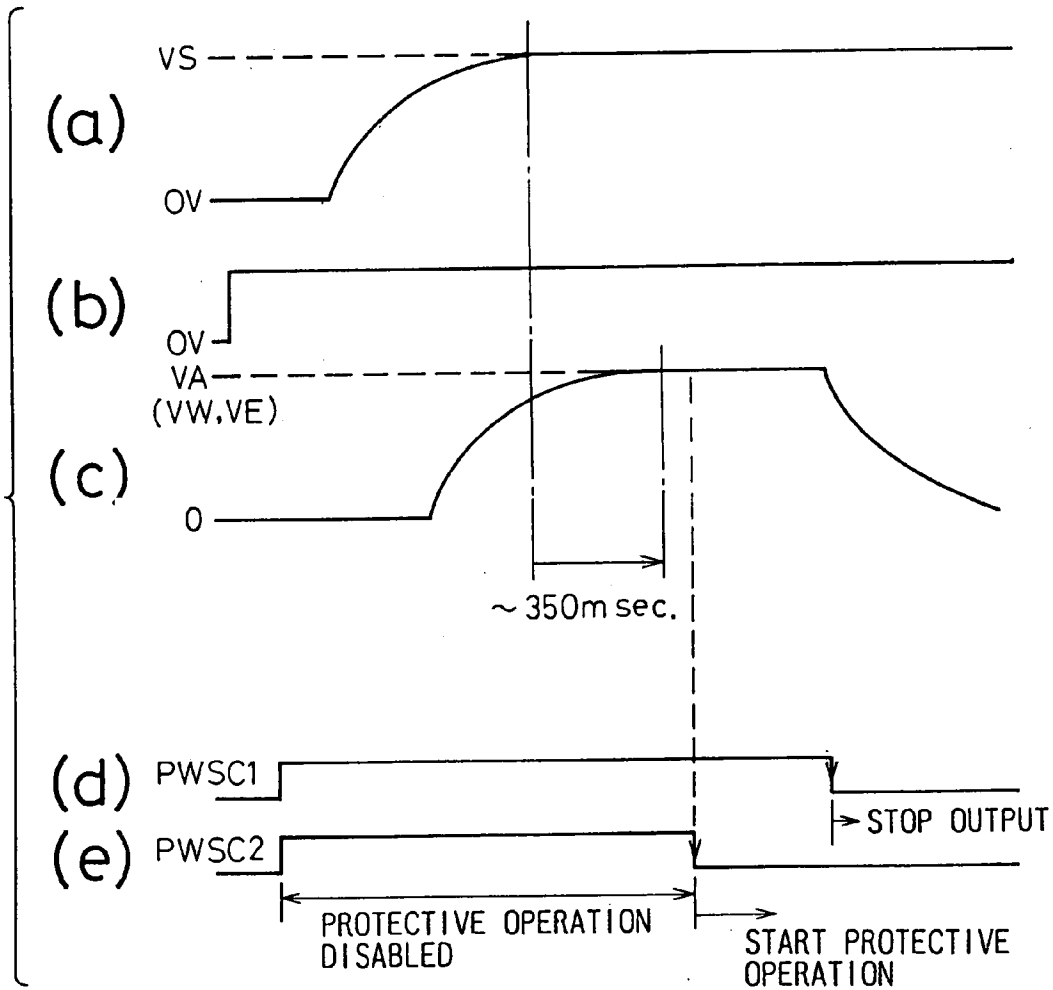
FIG. 13 is a diagram for explaining the operation of a timer mentioned in the flowchart of FIG. 12.
Figure 14:
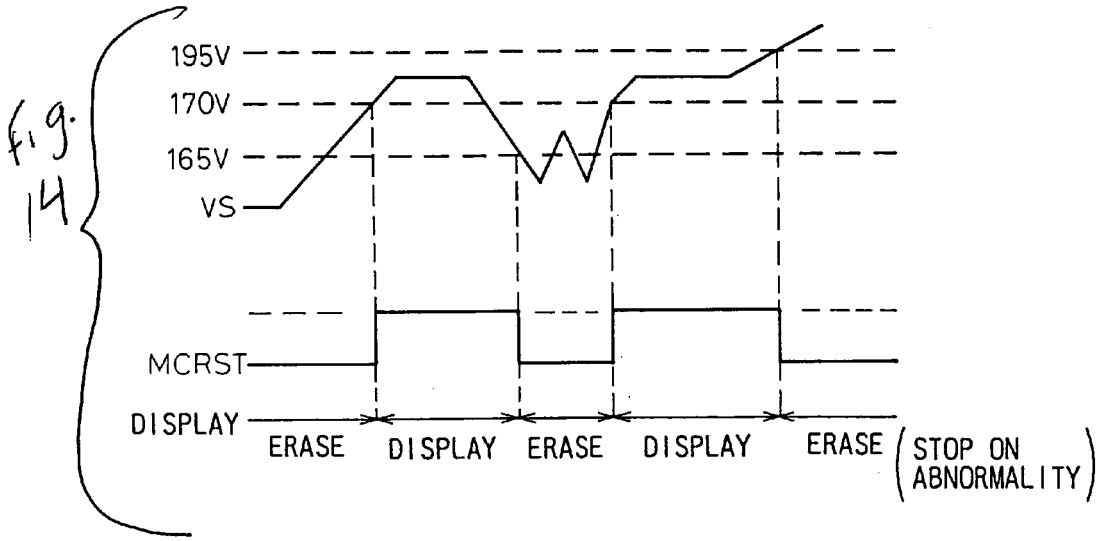
FIG. 14 is a diagram showing a waveform corresponding to the processes of the flowchart of FIG. 12.

FIG. 12 is a flowchart showing processes carried out in the flat display according to the present invention, FIG. 13 explains the operation of a timer shown in the flowchart, and FIG. 14 is a waveform corresponding to the processes shown in the flowchart.

In FIG. 12, the power supply Vcc is turned ON. The CPU 40 receives a reset signal RST of high level (H) from the power-on-reset circuit 66 and starts a program.

Step S1 carries out initialization in which driving waveforms are stopped in response to the drive control signals MCRST, MCPSD, and ADENA, and the operation of the internal protection circuit is disabled in response to the control signals PWSC1 and PWSC2.

Step S2 checks the high voltage VS. This step loops until the high voltage VS reaches a specified value, which is 170 V in FIG. 14. This value is set in advance in the CPU 40. Once the high voltage VS reaches the specified value, the loop ends and step S3 starts.

Step S3 compensates for a delay time according to a timer. The output voltage VA (VW, VE) shown in FIG. 13(*c*) of the internal power supply circuit 50 needs about 350 msec to reach a predetermined value after the high voltage VS (FIG. 13(*a*)) reaches the specified value. Step S3 secures this duration according to a timer. As shown in FIGS. 13(*d*) and 13(*e*) and Table 1, the signals PWSC1 and PWSC2 of each H disable the internal protection circuit. When the signal PWSC1 is H and the signal PWSC2 is L, the internal protection circuit is started. When the signals PWSC1 and PWSC2 are each L, the outputs of the internal power supply circuit 50 are stopped.

Step S4 starts the internal protection circuit in response to the control signals PWSC1 and PWSC2.

Step S5 checks the internal power supply to see whether or not the output voltages VA, VW, and VE of the internal power supply circuit 50 meet values stored in the CPU 40. If any one of the voltage values is abnormal, the flow branches to an abnormality process routine of step S10.

The abnormality process routine of step S10 provides the control signals PWSC1 and PWSC2 to stop the internal power supply circuit 50 and supplies the control signals MCRST, MCPSD, and ADENA to stop the control circuit 10. As a result, none of the drive waveforms of FIG. 4 is generated. Note that, this state is not cleared until a power-on-reset circuit is available by applying power supply voltage Vcc.

If step S5 determines that all of the drive voltages VA, VW, and VE are normal, step S6 starts the control circuit 10 including the display data controller 11 and panel driver controller 13 in response to the control signals MCRST, MCPSD, and ADENA. The signal MCRST is a reset signal for controlling the direct clear operation of all of the latch circuits and flip-flops provided in the display (driving circuit). The signal MCPSD is a reset signal for a synchronously resetting the high-voltage drivers. The signal ADENA is an enable signal for the address driver 21.

Step S7 checks the signal DISPENA (specific signal) applied from the external and the signal DERS applied from the control circuit 10, when at least one signal DISPENA and DERS is at a low level L, the flow returns to the initialization of step S1. Namely, when the apparatus having the display panel changes the signal DISPENA to a low level L or the user (operator) intentionally changes the signal DISPENA to a low level L, and/or when the display data DATA is not supplied during a specific period and the signal DERS is at a low level L, the flow returns to the initialization of step S1. In this case, the display is not only brought to the non-display state, but also unnecessary currents (reactive currents) for switching operations and charging/discharging operations which are only used for displaying are cut down, so that the consumption power of the display can be reduced.

On the other hand, when both signal DISPENA and DERS are at a high levels H, that is, when the apparatus having the display panel or the operator does not change the signal DISPENA to a low level L, and when the display data DATA is supplied from the external, the flow proceeds to Step 8.

Step S8 again checks the high voltage VS. If the high-voltage VS is at a specified value, step S9 checks the internal power supply voltages VA, VW, and VE. If step S8 determines that the high voltage VS is below the specified value, the flow returns to the initialization of step S1, and further, the flow proceeds to abnormality process routine of step S10. The specified value for checking the high voltage VS in step S8 is 165 V in FIG. 14, i.e., lower than the specified value of 170 V when checking the high voltage VS in step S2. This prevents abnormal operation in the program due to voltage fluctuations.

If the high voltage VS exceeds 195 V, the voltage is determined to be abnormal, and the flow branches to the abnormal process routine of step S10, which stops the internal power supply circuit 50 in response to the control signals PWSC1 and PWSC2, and the control circuit 10 in response to the control signals MCRST, MCPSD, and ADENA, as shown in FIG. 14.

When the high voltage VS reaches 175 V in FIG. 14, the internal power supply voltages VA, VW, and VE are checked to start displaying data. If the high voltage VS drops below 165 V, the initialization is again carried out, and the control circuit 10 is reset in response to the control signals MCRST, MCPSD, and ADENA, to erase the whole screen.

As described above, according to the present embodiment, when the display data DATA is not supplied during a specific period, when the high voltage (VS) is below a specific value set in the flat display, or when the specific signal DISPENA input from the external is at a specific level, charging currents that are irrelevant to an actual display operation and reactive currents due to useless switching operations are eliminated, so that power consumption can be reduced.

Figure 16:
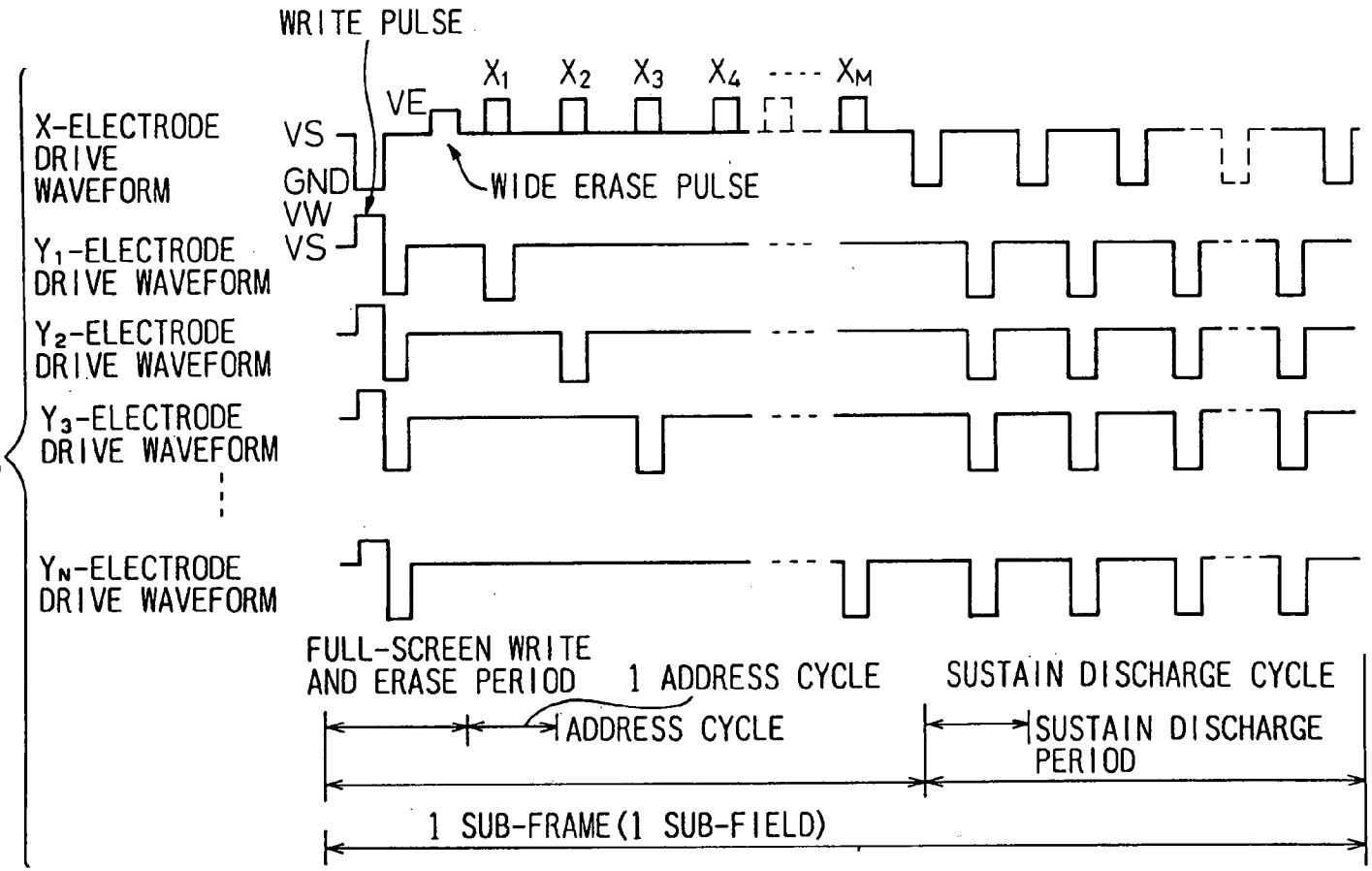
FIG. 16 is a diagram showing waveforms for driving the plasma display system of FIG. 15.

FIG. 15 is a block diagram showing a 2-electrode surface discharge AC plasma display according to another embodiment of the present invention, and FIG. 16 is a diagram showing waveforms for driving the plasma display of FIG. 15. In FIG. 15, reference 7A denotes X-electrodes ($X_1$ to $X_M$), and 21A denotes X-address driver.

By comparing FIG. 15 with FIG. 5, in the 2-electrode surface discharge AC plasma display of this embodiment, the X-electrodes 7 in the 3-electrode surface discharge AC plasma display are omitted, and the X-address driver 21A is provided instead of the address driver 21 in the 3-electrode surface discharge AC plasma display of FIG. 5. Further, in this 2-electrode surface discharge AC plasma display, the X-electrodes 7A are provided as the address electrodes ($A_1$ to $A_M$) 3 in the 3-electrode surface discharge AC plasma display of FIG. 5. Note, the driving waveforms of the 2-electrode surface discharge AC plasma display of this embodiment are described in FIG. 16.

In the 2-electrode surface discharge AC plasma display of this second embodiment, the other configurations or special characteristics of the present invention are the same as that of the 3-electrode surface discharge AC plasma display of the above first embodiment. Further, the flat display of the present invention are not only applied to 2-electrode or 3-electrode surface discharge AC plasma display, but also can be applied to various types of flat displays, e.g., flat displays employing a plasma display panel, an electroluminescence panel, a liquid crystal panel, a fluorescent display tube, light emitting diodes, and the like.

As explained above in detail, the flat display according to the present invention eliminates charging currents that are irrelevant to an actual display operation and reactive currents due to useless switching operations, thereby reducing power consumption.

Many different embodiments of the present invention may be constructed without departing from the spirit and scope of the present invention, and it should be understood that the present invention is not limited to the specific embodiments described in this specification, except as defined in the appended claims.

The invention claimed is:

1. A flat plasma display for displaying data in accordance with a high voltage and drive voltages produced from said high voltage, wherein said flat plasma display comprises:

a first high voltage decision unit determining whether or not said high voltage is at a specific value or within a specific range after a power supply is turned on and initialization is carried out;

a first drive voltage decision unit determining whether or not said drive voltages are at specific values or within specific ranges;

a second high voltage decision unit determining whether or not said high voltage is kept at the specific value or within the specific range after the start of a protective operation of an internal power supply circuit that generates said drive voltages;

a second drive voltage decision unit determining whether or not said drive voltages are kept at the specific values or within the specific ranges; and a drive control signal control unit controlling drive control signals of said flat plasma display in response to the decided results of said first and second high voltage decision units and said first and second drive voltage decision units.

2. A flat plasma display as claimed in claim 1, wherein the control of said internal power supply circuit is carried out together with the control of said drive control signals in response to the decided results of said second drive voltage decision unit.

3. A flat plasma display as claimed in claim 1, wherein said flat plasma display is initialized when said second high voltage decision unit determines that said high voltage is not kept at the specific value or the specific range, and an internal power of said internal power supply circuit and said drive voltages are cut OFF when said second drive voltage decision unit determines that said drive voltages are not kept at the specific values or within the specific ranges.

4. A flat plasma display as claimed in claim 1, wherein said flat plasma display further comprises a time compensation unit for compensating for the time between the instant that said high voltage is applied until said drive voltages reach the specific values.

5. A flat plasma display as claimed in claim 1, wherein said specific value compared with said high voltage in said first high voltage decision unit differs from sold specific value compared with said high voltage in said second high voltage decision unit.

6. A flat plasma display as claimed in claim 1, wherein said flat plasma display comprises a three-electrode surface discharge AC plasma display.

7. A flat plasma display as claimed in claim 6, wherein said three-electrode surface discharge AC plasma display further comprises:

first and second electrodes arranged in parallel with each other, and third electrodes orthogonal to said first and second electrodes, said first electrodes being commonly connected together and said second electrodes being arranged to define respective display lines, wherein said display has a surface discharge structure employing wall charges as a memory.

8. A flat plasma display as claimed in claim 7, wherein said three-electrode surface discharge AC plasma display further comprises:

a first substrate, said first and second electrodes being arranged in parallel to each other on said first substrate and paired for defining respective display lines;

a second substrate spaced apart from and facing said first substrate, defining a cavity therebetween, said third electrodes being arranged on said second substrate in orthogonal relationship to said first and second electrodes and displaced therefrom;

wall charge accumulating dielectric layers respectively covering the surfaces of said first and second electrodes;

a phosphor formed over said second substrate;

a discharge gas sealed in the cavity between said first and second substrates; and cells formed at intersections where said first and second electrodes cross said third electrodes.

9. A flat plasma display employing a first high voltage for supplying a sustain pulse, comprising:

an internal power supply circuit generating a plurality of drive voltages from said first high voltage;

a voltage detection unit detecting respective levels of the first high voltage and other drive voltages which are produced by said first high voltage;

an internal power supply controlling unit producing power supply control signals controlling an operation of said internal power supply circuit according to the detected, respective levels of the first high voltage and the plural drive voltages, wherein the internal power supply controlling unit produces a power supply control signal to stop the operation of the internal power supply circuit in a case when any one of the respective detected levels of the first voltage and the plural drive voltages is out of a predetermined level range.

10. A flat plasma display as claimed in claim 9, wherein said internal power supply controlling unit stops the operation of said internal power supply circuit by changing said power supply control signals in response to said detected first high voltage and other drive voltage.

11. A flat plasma display employing a first high voltage for supplying a sustain pulse, comprising:

a voltage detection unit detecting said first high voltage;

an internal power supply circuit receiving said first high voltage and generating another high voltage different from said first high voltage; and an internal power supply controlling unit storing first and second specific values, the first specific value being greater than the second specific value, and selectively comparing the stored first and second specific values with the detected first high voltage, the first specific value being used when the first high voltage is rising and the second specific value being used when the first high voltage is falling, and controlling an operation of the internal power supply circuit in response to the compared result of the detected first high voltage, where said internal power supply controlling until starts the operation of the internal power supply circuit when the detected first high voltage is higher than the first specific value, and stops the operation at the internal power supply circuit when the detected first high voltage is lower than the second specific value.

12. A flat plasma display as claimed in claim 11, wherein said internal power supply controlling unit starts a circuit operation through a control circuit if said detected first high voltage reaches said first specific value, and stops the circuit operation through said control circuit if said detected first high voltage is below said second specific value.

13. A flat plasma display employing a first high voltage for supplying a sustain pulse, comprising:

an internal power supply circuit generating a plurality of drive voltages from the first high voltage; end a voltage detection unit detecting at least one of the plural drive voltages;

wherein when any level of the plural drive voltages detected by the voltage detection unit is out of an predetermined level range, the operation of the internal power supply circuit, corresponding to the drive voltage which is detected to be out of the predetermined level range, is controlled to stop the operation.

14. A flat plasma display as claimed in claim 13, wherein the plural drive voltages are voltages which are supplied in a display electrode during a period different from a display discharge period.

* * * * *

UNITED STATES PATENT AND TRADEMARK OFFICE

CERTIFICATE OF CORRECTION

PATENT NO. : 7,068,264 B2
APPLICATION NO. : 09/974806
DATED : June 27, 2006
INVENTOR(S) : Shigetoshi Tomio et al.

It is certified that error appears in the above-identified patent and that said Letters Patent is hereby corrected as shown below:

Column 14, line 37, change “sold” to --said--

Column 14, line 47, change “other,” to --other;--

Column 15, line 28, change “voltage.” to --voltages.--

Column 16, line 8, change “until” to --unit--

Column 16, line 11, change “at” to --of--

Column 16, line 23, change “end” to --and--

Signed and Sealed this

Second Day of January, 2007

JON W. DUDAS
*Director of the United States Patent and Trademark Office*